United States Patent [19]

Bowden

[11] Patent Number: 4,902,202

[45] Date of Patent: Feb. 20, 1990

[54] VARIABLE DISCHARGE GEAR PUMP WITH ENERGY RECOVERY

[75] Inventor: Charles J. Bowden, Battle Creek, Mich.

[73] Assignee: Hydreco, Inc., Augusta, Ga.

[21] Appl. No.: 220,234

[22] Filed: Jul. 20, 1988

Related U.S. Application Data

[63] Continuation-in-part of Ser. No. 79,010, Jul. 29, 1987, Pat. No. 4,824,331.

[51] Int. Cl.[4] ..... F04C 29/08; F04B 49/02; F04B 49/08

[52] U.S. Cl. ..... 417/310; 417/189

[58] Field of Search ..... 417/295, 310; 418/180, 418/189

[56] References Cited

U.S. PATENT DOCUMENTS

| | | | |
|---|---|---|---|
| 2,310,078 | 2/1943 | Herman | 417/310 |
| 2,498,790 | 2/1950 | Caughrean | 418/189 |
| 3,023,706 | 3/1962 | De Fezzy et al. | 417/310 |
| 4,097,206 | 6/1978 | Schonherr | 418/180 |

*Primary Examiner*—Leonard E. Smith
*Attorney, Agent, or Firm*—Barnes & Thornburg

[57] ABSTRACT

Variable discharge and energy recovery is produced by an adjustable spool in fluid communication with the outlet chamber for adjustably providing pressurized fluid from the outlet chamber to selected portions of the demeshing area of the intermeshing teeth to vary the discharge flow of the pump and the amount of energy recovery. This results in maintaining a positive pressure in selected portions of the demeshing area as well as equalizing the pressure in the selected areas to the pressure in the outlet chamber. The adjustable spool also controls the connection between the inlet chamber and the demeshing area to vary the energy recovery.

10 Claims, 10 Drawing Sheets

STANDARD PUMP WITH DRY VALVE
(IN DRY MODE OR STAND BY)

INVENTION (STAND BY)

VARIABLE DISCHARGE GEAR PUMP WITH ENERGY RECOVERY

BACKGROUND AND SUMMARY OF THE INVENTION

This application is a continuation-in-part of U.S. Pat. Application Serial No. 079,010, filed Jul. 29, 1987, now U.S. Pat. No. 4,824,331.

The present invention relates generally to variable discharge gear pumps and more specifically to a variable discharge gear pump having energy recovery.

Gear pumps generally include a pair of oppositely rotating gears having an intermeshed area between an inlet and an outlet. The meshing teeth of the gears open on the inlet side filling the pockets and carrying fluid around to the outlet side. The teeth mesh on the outlet side creating a positive pressure and demesh on the inlet side creating a negative pressure. Generally the axes of the pair of gears are fixed and parallel to each other.

Many methods have been used to vary the discharge of gear pumps. These have included: (a) adjustment of the inlet or outlet structure to determine when compression begins or ends; (b) axial adjustment of the gears relative to each other to adjust the effective axial length of the intermeshing gears; (c) adjustment of the depth of the intermeshing generally via an eccentric; (d) passing fluids to and from the peripheral chambers to vary the throughput; (e) external valves for connecting the inlet and outlet; and (f) the provision of multiple stages with the selectivity of the number of stages used.

In U.S. Pat. No. 1,912,737 to Svenson, radial passages are provided in the gear teeth to communicate the inlet, outlet and meshing areas with a adjustable valve port in the interior of the gears. By adjustment of the valve port, fluid from the outlet is bypassed back to the inlet thereby reducing the discharge of the pump. Because of the size of the radial passages in the gear teeth, the high pressure fluid in the outlet and decreasing displacement meshing area of the teeth force fluid into the interior porting area, and the increasing displacement demeshing area of the meshing teeth and the low pressure inlet draw fluid from the interior valving port. Also, depending upon the speed of the gears, the radial passages become effectively smaller and more restrictive with increased speed.

U.S. Pat. No. 1,985,748 to Svenson shows a similar design to the '737 patent.

U.S. Pat. No. 2,481,646 to Conklin is a typical example of a variable delivery gear pump wherein high pressure fluid from the outlet side is adjustably connected to the pockets of the gear on the inlet side. By adjusting the rectilinear element, the number of pockets that are prefilled with fluid from the outlet side of the pump are selected. This not only bypasses fluid from the outlet to the inlet, but also provides it directly at the open pockets and therefore varies the throughput.

Although these three patents are examples of variable delivery gear pumps wherein the axes of the parallel gears are fixed and fluid is fed back from the output to the input, they fail to recognize the ability to recover energy and substantially reduce the amount of torque needed to drive the gear pump. The specific location of the introduction of the outlet fluid to the inlet fluid, outside the meshing area of Conklin, prevents the use of the high pressure outlet fluid in an area which is capable of recovering energy. The two discussed Svenson patents, although removing fluid from the meshing and providing fluid to the demeshing area of the gears, as well as providing a bypass of outlet fluid to the inlet, the structure of the fluid passages are such that they fail to provide high pressure fluid at the demeshing area of the intermeshing teeth and therefore also does not recover energy.

U.S. Pat. No. 3,669,577 to Swanson is an example of a variable displacement gear pump wherein the gears move axially relative to each other to vary the displacement. This patent also includes radial channels in the teeth of the gears to receive fluid from the inlet chamber and to propel it under centrifugal force into the opening areas on the demeshing gear side to relieve the vacuum of the demeshing gears to thereby reduce vaporization and consequently improve the efficiency of the pump. These channels are not used to effect the displacement of the pump, nor recover energy since the fluid in the channels of the gears are cut off from the high pressure outlet fluid.

Therefore, there exists a need for a variable discharge gear pump of the fixed axis design which includes variable energy recovery.

Thus it is an object of the present invention to provide a variable discharge gear pump having fixed gear displacement which includes energy recovery.

Another object of the present invention is to provide a variable discharge gear pump having variable energy recovery.

A still further object of the present invention is to provide a variable discharge gear pump and energy recovery with a minimum number of parts.

An even further object of the present invention is to provide a large capacity pump which has the reduced loading of smaller capacity pumps.

These and other objects of the invention are attained by providing a outlet adjustment in fluid communication with the outlet chamber for adjustably providing high pressurized fluid from the outlet chamber to selected portions of the demeshinq area of the intermeshing teeth which are between the inlet and outlet chambers to vary the discharge flow of the pump and the amount of energy recovery. This results in maintaining a positive pressure in selected portions of the meshing area as well as equalizing the pressure in the selected areas to the pressure in the outlet chamber. To further vary the energy recovery, an inlet adjustment is provided connecting the inlet chamber and the demeshing area for variably controlling the flow therebetween. The inlet and outlet adjustments are coordinated whereby fluid flow between the inlet chamber and the demeshing area decreases with decreasing discharge flow to thereby increase the energy recovery. The inlet adjustment controls the primary flow between the inlet chamber and the demeshing area. This adjustment, by decreasing the flow communication to the inlet chamber, allows greater pressure to build up in the demeshing area and thereby increase energy recovery.

The inlet and outlet adjustments include a common spool having a channel and an inlet land. The channel in the spool connecting the outlet and the intermeshing areas is of sufficient dimension to assure that sufficient fluid of high pressure is provided in selected portions of the demeshing area of the gears. This channel is a recess, slot or undercut in the spool which is in continuous communication with the outlet chamber. The inlet land varies the primary fluid flow between the inlet chamber and the demeshing area. The spool is positioned rectilinearly along an axis to align the slot in communication with the selected portions of the intermeshing areas and vary the inlet primary fluid flow. The width of the slot is substantially equal to the height of the teeth of the gears so as to overlap teeth in the intermeshing area and not reduce the pressure available from the outlet chamber. The axis of rectilinear movement of the spool is perpendicular to the plane of the parallel axis of rotation of the pair of gears and is equidistant from the parallel axis. The slot extends from the outlet chamber and over contiguous portions of the meshing and demeshing areas as adjusted.

Secondary channels continuously connect the inlet to the gear teeth exterior the intermeshing area for preventing cavitation without decreasing energy recovery. The required torque is reduced by using the high pressure outlet energy to minimize the pressure differential between the meshing and demeshing areas of the intermeshing gear teeth and decreasing the fluid connecting to the inlet chamber. Pressurizing the inlet meshing area also helps pressure balance the gears reducing mechanical torque, journal loading and heat during the discharge flow reduction.

Other objects, advantages and novel features of the present invention will become apparent from the following detailed description of the invention when considered in conjunction with the accompanying drawings.

DETAILED DESCRIPTION OF THE DRAWINGS

Figure 1:
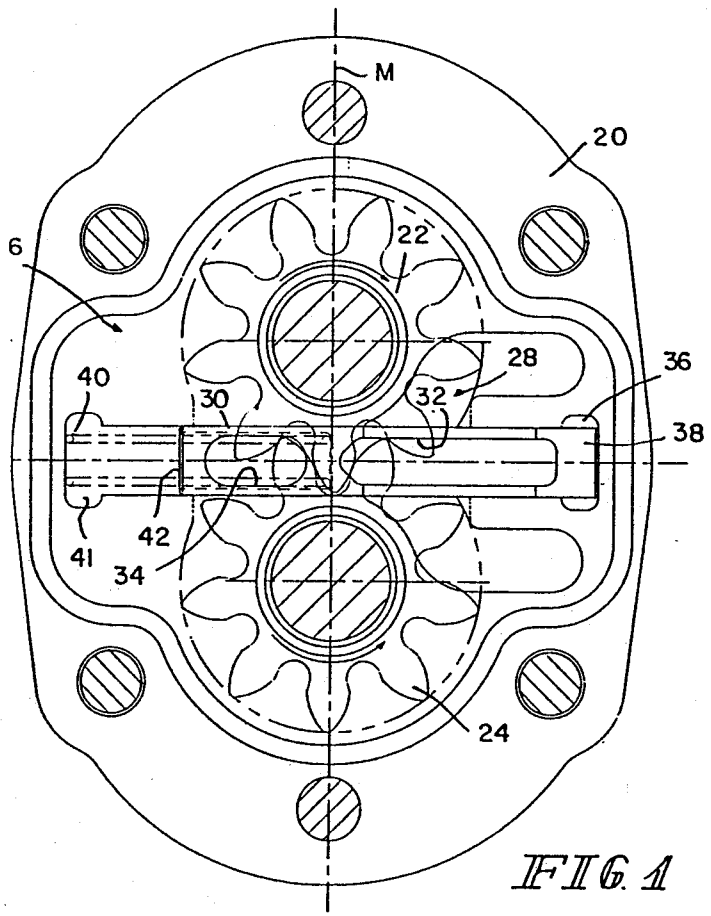
FIG. 1 is a cross-sectional view of a variable discharge gear pump having adjustable energy recovery in its full discharge, zero energy recovery mode incorporating the principles of the present invention.
Figure 4:
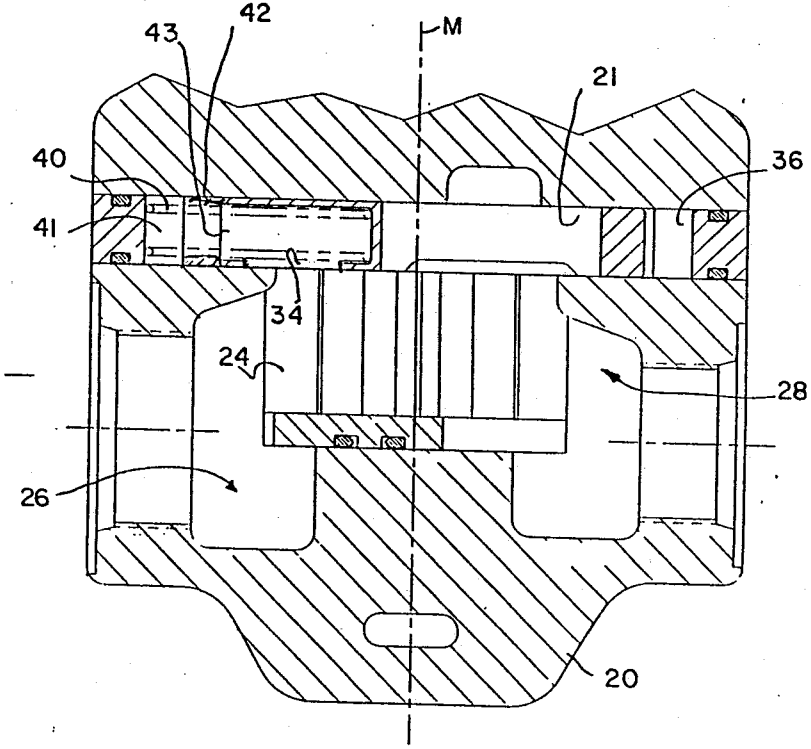
FIG. 4 is a cross-sectional view taken along lines IV—IV of FIG. 2.

A gear pump, as shown in FIG. 1, includes a housing 20, having a pair of intermeshing gears 22 and 24 rotated about parallel fixed axes in opposite directions. The gears 22 and 24 are positioned between an inlet chamber 26 and an outlet chamber 28 of the pump. The intermeshing gears have a center line M with a meshing area of decreasing displacement of the teeth on the outlet side to the right of the center line M as is depicted in FIG. 1, and a demeshing area of increasing displacement of the teeth on the inlet side or to the left of center line M.

The general operation of a gear pump is well known and will not be described in detail herein, except for the following standard operation. Low pressure fluid from the inlet chamber 26 is carried around the exterior within the grooves of the teeth of gears 22 and 24 and deposited in the high pressure outlet chamber 28. The meshing teeth at the outlet forces the fluid out and creates the high pressure at the pump outlet and the demeshing teeth on the inlet side lowers the pressure on the inlet drawing fluid into the teeth grooves The average differential pressure between the meshing and demeshing areas of the intermeshing teeth plus mechanically induced torque determines the overall torque required to drive the gears 22 and 24. The larger the average differential pressure between the meshing and demeshing areas of the intermeshing teeth, the more torque is required.

FIGS. 7–14 show graphs of the pressure and torque for various pumps of the prior art and the invention. The pressure profile is shown in the solid line and the required operating torque is shown in the dashed line. These graphs are comparisons only and have typical inlet and discharge pressures (atmospheric inlet pressure is used).

Figure 7:
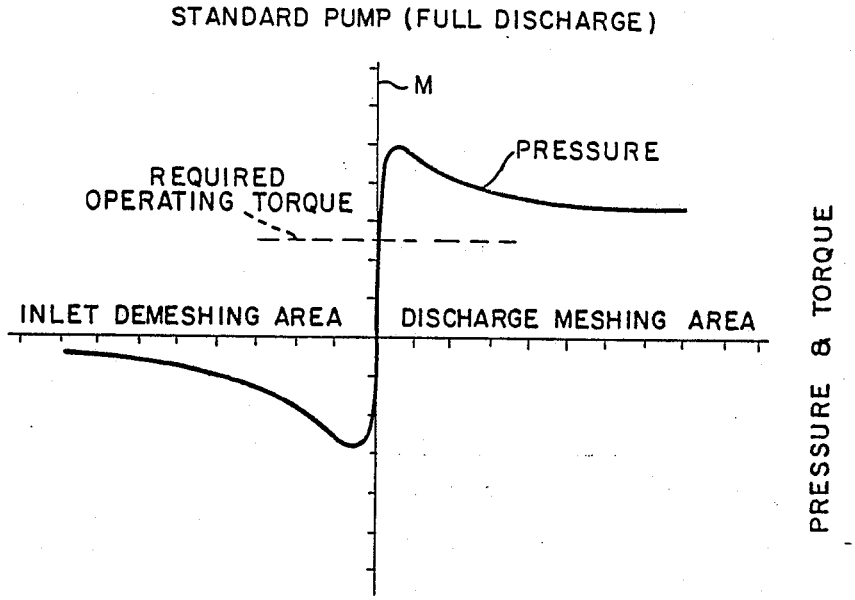
FIG. 7 is a pressure torque graph for a standard pump at full discharge.

In FIG. 7, of a standard pump with full discharge flow requirement, and anti-trapping and cavitation structure, the pressure on the discharge meshing area increases slightly from the outlet pressure to an increased Pressure towards the center line M. As the teeth enter the demeshing area, a minimal vacuum is created which diminishes as the teeth further demesh to the pump inlet pressure which is a close to atmosphere. The required operating torque is an average as a function of the differential pressures, FIG. 7 also represents the invention at full discharge flow.

Figure 8:
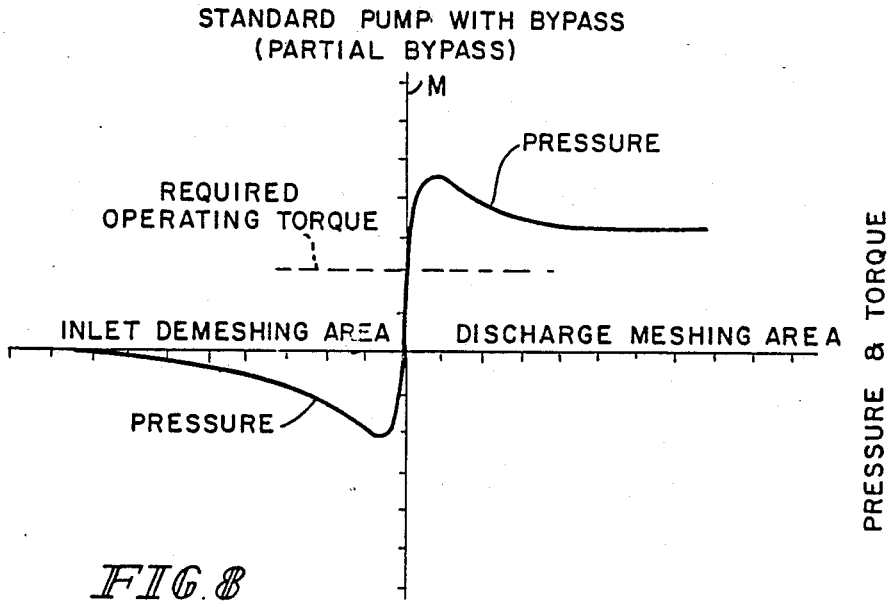
FIG. 8 is a pressure torque graph of a standard pump with bypass at partial bypass.
Figure 9:
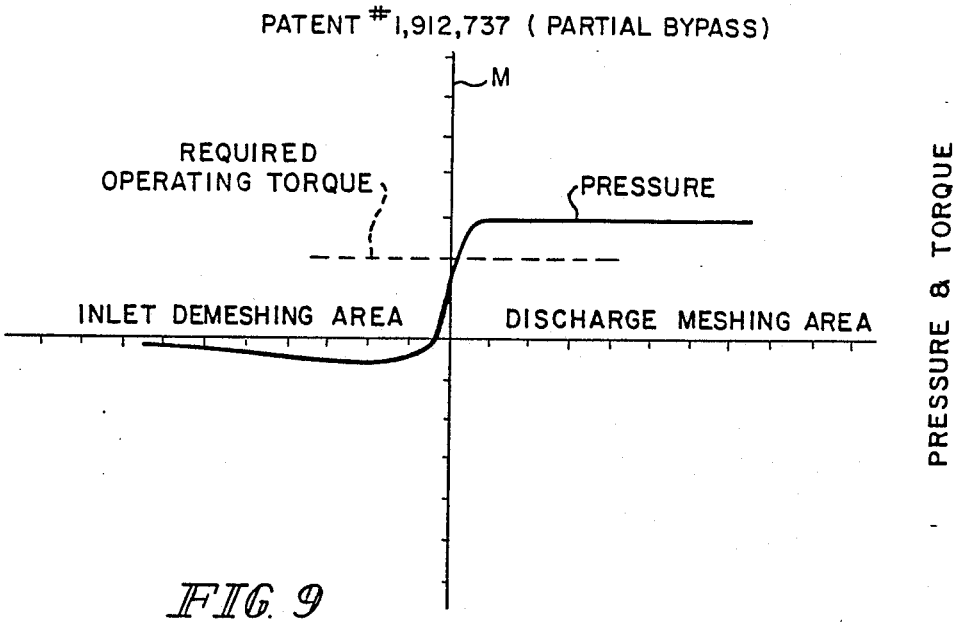
FIG. 9 is a pressure torque graph for U.S. Pat. No. 1,912,737, at partial bypass.
Figure 10:
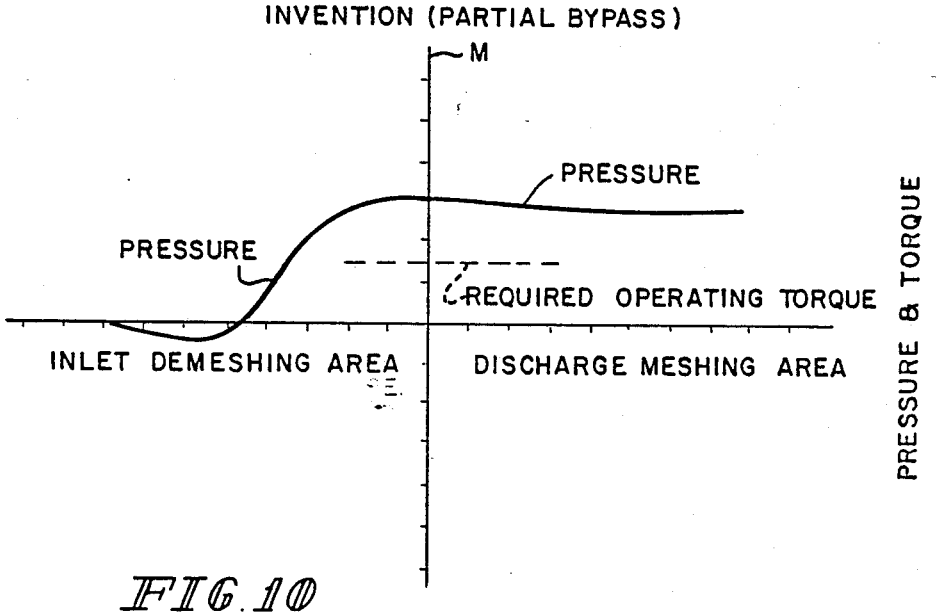
FIG. 10 is a pressure torque graph of a pump according to the present invention as in FIG. 2 with partial bypass.

FIGS. 8–10 represent bypasses of prior art and the invention with typical bypass flow and pressure.

In a standard pump with bypass of fluid to the inlet, as illustrated in FIG. 8, there is no change in the meshing area, but the amount of vacuum in the demeshing teeth is reduced slightly. This reduces the torque required by a small amount as compared to FIG. 7.

A standard pump with bypass to tank has no profile change so it remains as shown in FIG. 7.

Another typical bypass structure, illustrated by FIG. 9, is that of U.S. Pat. No. 1,912,737. Because of its specific structure, the communication of a fluid between the meshing and demeshing areas is restricted and the amount of fluid flowing from and to the meshing and demeshing areas is a function of the speed of operation. Thus, fluid is not freely flowing to maintain the demeshing areas filled with high pressure fluid. So, there is still a substantial pressure differential between the meshing and demeshing area. There is a minimal reduction in torque required over the standard pump with bypass to inlet of FIG. 8.

Figure 2:
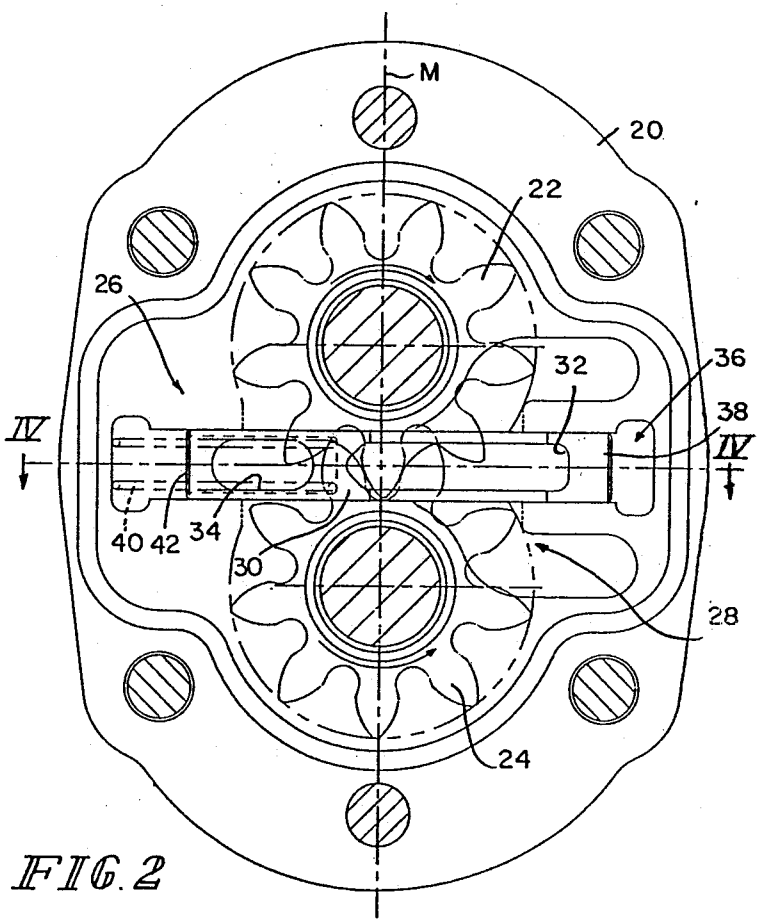
FIG. 2 is a cross-sectional view of the pump of FIG. 1 in a less than full discharge and partial energy recovery mode.

In comparison to FIGS. 8 and 9, the present invention of FIG. 2 is designed to achieve the pressure and torque profile of FIG. 10 during partial bypass. The pressure profile on the discharge meshing area is substantially flat with a small rise approaching the center M of the intermeshing area. This is produced by a minimum amount of restriction in the intermeshing teeth. The pressure on the inlet demeshing area begins substantially at this pressure and decreases, in the manner shown in FIG. 10, to the pump inlet. By reducing the pressure differential of the meshing and demeshing areas, the required torque is substantially less than that of the Figures of the prior art.

FIG. 11–14 are graph comparisons of prior art and the invention in the standby or full bypass mode. In this mode there is a small amount of discharge flow diverted to tank, in some means, at a low pressure to provide cooling during this mode. Standby or full bypass mode is when there is no requirement for discharge flow to operate a function. The graphs are shown with typical discharge and inlet pressures as in previous graphs.

Figure 11:
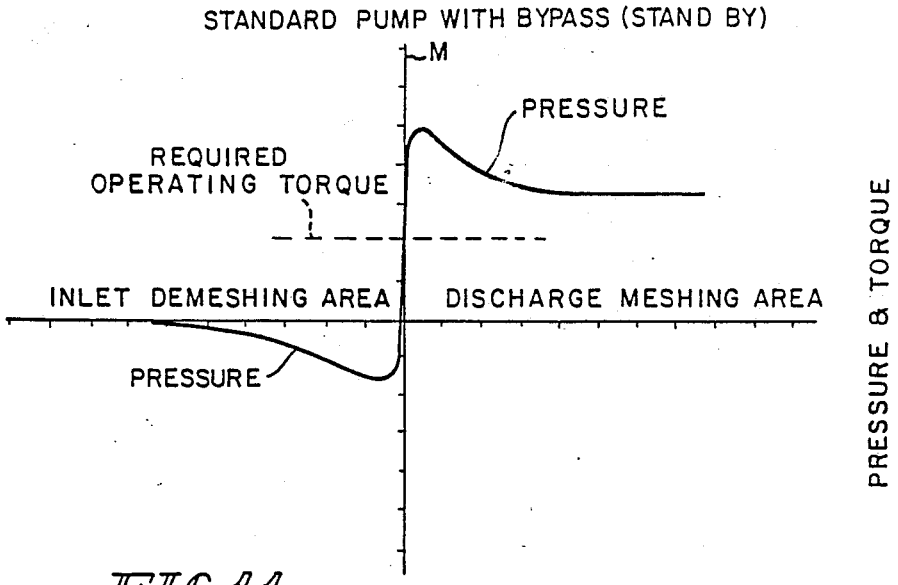
FIG. 11 is a pressure torque graph of a standard pump with bypass at standby.

FIG. 11 shows a standard pump with bypass to inlet in the standby mode. This graph shows no change in the discharge meshing area and a small change in the inlet meshing area which reduces the torque requirement slightly over the bypass to tank pump illustrated again in FIG. 7.

Figure 12:
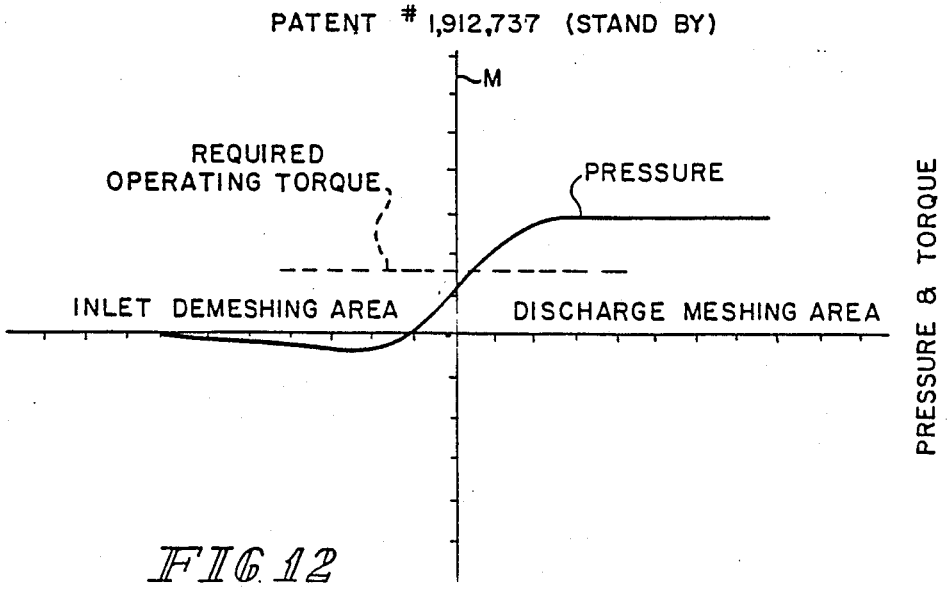
FIG. 12 is a pressure torque graph of the pump of U.S. Pat. No. 1,912,737, at standby.

FIG. 12 illustrates the pump of U.S. Pat. No. 1,912,737 in full bypass and shows an improvement in torque requirement over FIGS. 11 and 7, yet it is still minimal in comparison to the invention.

Figure 13:
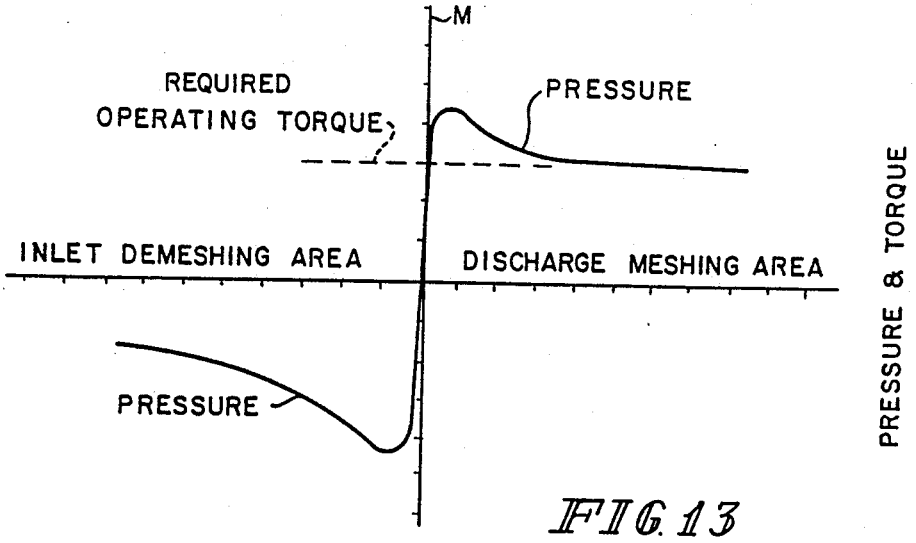
FIG. 13 is a pressure torque graph of a standard pump with dry valve in dry mode or at standby.

In a standard pump with a dry valve as shown in FIG. 13, there is very little change of the pressure profile on the meshing area, but there is a substantial increase in the vacuum and the maintaining of the vacuum on the inlet chamber and the demeshing area. This increases the torque required over that of the standard pump with full bypasses of prior art, shown in U.S. Pat. No. 1,912,737, and the invention.

Figure 3:
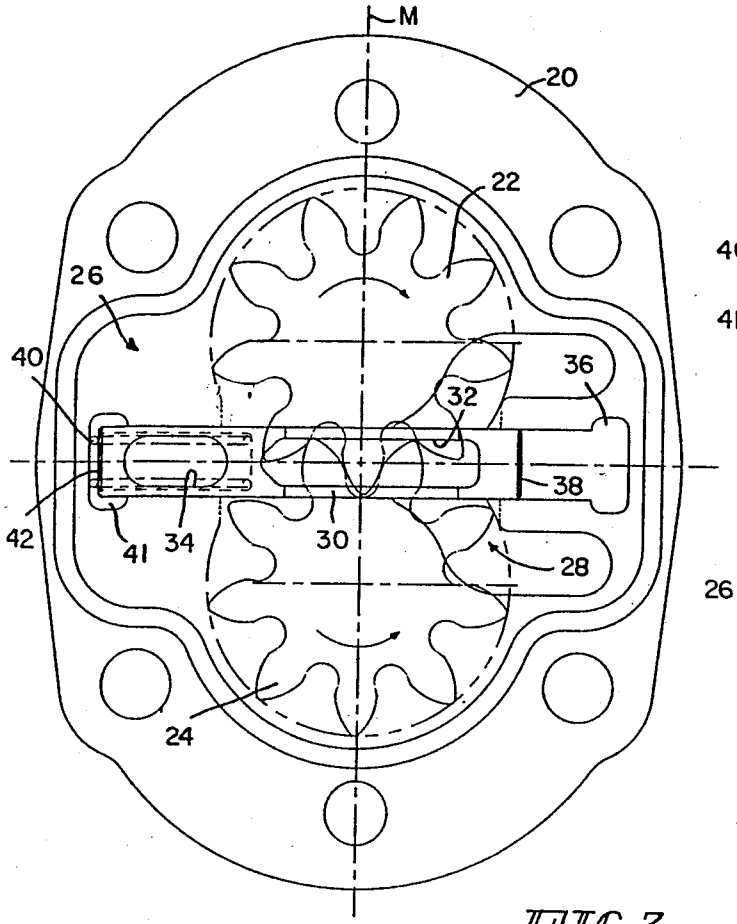
FIG. 3 is a cross-sectional view of the pump of FIG. 1 in a full bypass mode.
Figure 14:
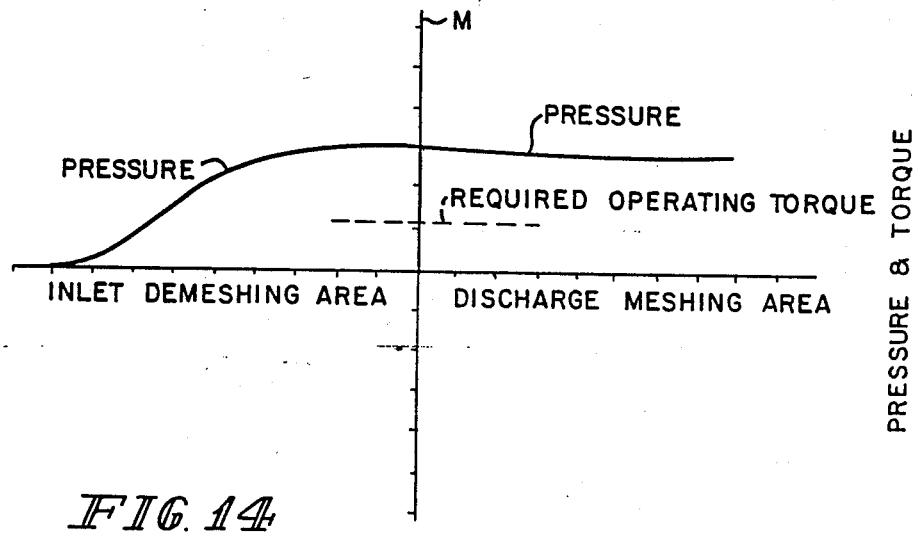
FIG. 14 is a pressure torque graph of a pump according to the present invention as in FIG. 3 at standby or full bypass.

FIG. 14 is the invention of FIG. 3 in standby and shows a substantial decrease in the differential pressure between the meshing and demeshing area and a marked improvement in the torque requirement compared to prior art.

To achieve the operation of FIGS. 10 and 14, a positive high pressure fluid must be provided in the intermeshing area. This is achieved by providing a communication between the outlet chamber, the meshing area, and the demeshing area in an attempt to provide more than enough fluid into the demeshing area and attempt to equalize the pressure thereacross, by reducing the differential pressure between the meshing and demeshing areas, and substantially removing the negative pressure portion on the demeshing side, thereby creating a positive pressure on the demeshing area, energy recovery is possible. This produces a substantial reduction in the required torque. In the ideal case, the positive pressure in the demeshing area if maintained as high as possible, would result in a torque requirement proportional to the discharge flow. This does not account for the mechanical and heat losses in the system.

To achieve the operational characteristics of FIGS. 10 and 14, a spool 30, as illustrated in FIG. 1–4, is provided externally between the inlet chamber 26 and the outlet chamber 28 and across the intermeshing area. Slots 32 and 34 in the spool 30 are in the outlet and inlet chamber respectively. The spool 30 has a first end 38 lying in a signal pressure chamber 36. The other end 42 of spool 30 lying in pressure chamber 41 is biased opposite the pressure in chamber 36 by a spring 40. A manual or fluid signal provided in pressure chamber 36 and/or chamber 41, determines the position of the spool 30. The spool 30 moves rectilinearly along an axis which is perpendicular to the parallel axis of rotation of gears 22 and 24 and is equidistant to the parallel axis of rotation of the gears 22 and 24.

As illustrated, the spring 40 lies within a bore 43 in the end 42 of the spool 30. Since the recess 34 is an anti-trapping recess and is an optional feature which may be deleted, the bore 43 will then be isolated from the inlet chamber 26 and therefore capable of sealing chamber 41 with respect to the inlet chamber 26. Thus, chamber 41 may receive a control pressure such that the spool 30 can be positioned based on the differential pressure between the chamber 41 on the left side of the spool and chamber 36 on the right side of the spool. As a further alternative, the bore 43 may be eliminated and the spring 41 may engage the outermost face of the end 42 such that an anti-trapping recess 34 may be provided and the pressure chamber 41 may also be isolated from the valve inlet chamber 26.

It should be noted, as illustrated in FIGS. 1–4, the primary inlet fluid flow is between the inlet chamber 26 and the edges of the gear teeth. The anti-trapping recess 34 merely Provides a secondary connection between the inlet chamber 26 and the demeshing area along the face of the gears. Thus, the anti-trapping recess 34 have little if any effect on the primary inlet fluid flow to the demeshing teeth, although it does aid in providing inlet fluid to the demeshing area to minimize the formation of a vacuum when there is no bypass or little bypass as in FIGS. 1 and 2.

As illustrated in FIG. 1, the spool is in its right-most position which corresponds to full pump discharge, with no energy recovery. As will be noted more fully below, the length of the slot 32 is sufficient such that it is in constant communication with the outlet chamber 28. Even in the far-right or full discharge position of spool 30, slot 32 communicates with the meshing area of teeth 22 and 24 so as to equalize the pressure in the meshing section with the pressure in the outlet chamber 28. Recess 34 in the inlet side of spool 30 is positioned in its right-most position of the demeshing area and attempts to equalize the pressure in the pump inlet chamber 26 with the demeshing area of the gear teeth. This more quickly dissipates the vacuum created by the demeshing teeth and thereby helps to reduce the drag produced by the vacuum.

When the spool 30 is moved to the left, either manually or by a pressure signal in chamber 36 and/or chamber 41, it is positioned as illustrated in FIG. 2 in a reduced discharge and partial energy recovery position. Slot 32, which is in continuous communication with the high pressure outlet chamber 28, extends across the full meshing area of the teeth and partially into the demeshing area to the left side of the center line M. Recess 34 at the other end of spool 30 is removed from the demeshing area and therefore has no effect on the pressure in the demeshing area.

Figure 5:
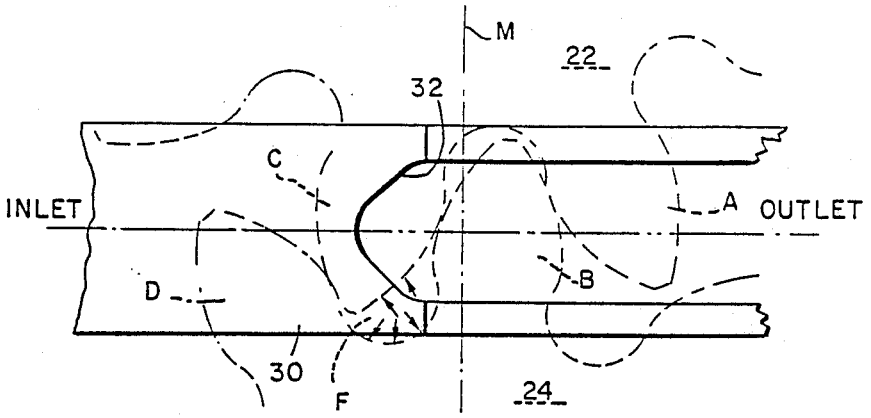
FIGS. 5 and 6 are enlarged views of the intermeshing area of FIG. 2 at two different stages of rotation illustrating energy recovery according to the principles of the present invention.
Figure 6:
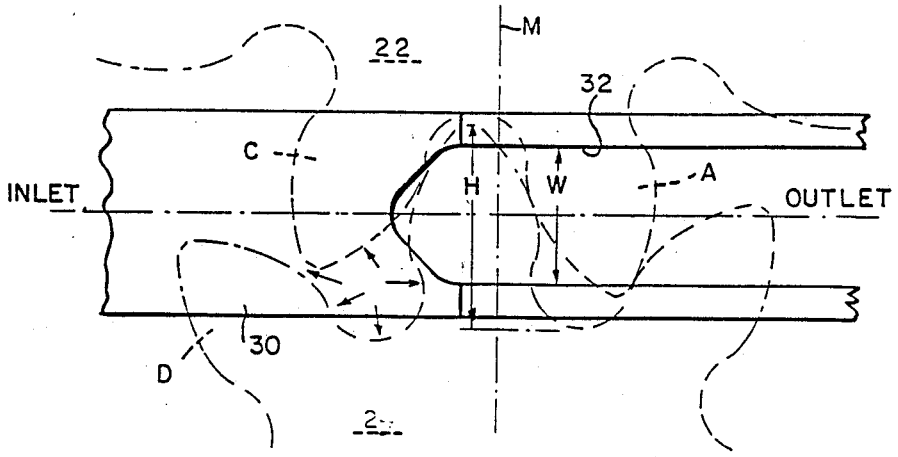

An enlarged view of the relationship of the relation of the slot 32 of the spool 30 and the intermeshing area of the teeth is illustrated in FIGS. 5 and 6. It should be noted that in FIGS. 1–3, 5 and 6, the gears are shown as being transparent so as to illustrate the juxtaposition of the elements and their operation. In FIG. 5, teeth A and C of gear 22 mate and intermesh with teeth B and D of gear 24 to provide an effectively sealed volume F therebetween on the left side of the center line M. The slot 32 extends from the outlet across the total meshing area and extends slightly past M into the demeshing area.

The width of the slot 32 is substantially large so as to not restrict the transmission of pressure from the outlet chamber 28 to the intermeshing areas. As illustrated specifically in FIG. 6, the width W of the slot 32 extending substantially across the height of the intermeshing of the teeth and being substantially equal to the height of the tooth H illustrated for tooth B.

Referring back to FIG. 5, the substantially sealed volume F of the intermeshing teeth has a substantial constant area extending on the demeshing side of the center line M. The high pressure in the outlet is provided in the volume F. This high pressure causes force of separation on the demeshing side of the center line M and thereby generates an energy recovery force. The amount of fluid transmitted from the outlet through slot 32 to the demeshing side of the gears reduces the amount of fluid being discharged. Thus, slot 32 of the spool serves simultaneously as an adjustment of the discharge of the variable discharge pump as well as to determine the amount of energy recovery.

In FIG. 6 the spool 30 is at the same location with slot 32 extending slightly past the center line M into the demeshing area and the gears 22 and 24 have rotated a degree or two. Tooth B extends deeper into the area between teeth C and A which would normally substantially compress the fluid therein. With the slot 32 extending substantially to the top of the tooth B in the bottom of the valley between teeth A and C, excessive pressure of compression is equalized with the outlet chamber pressure.

With further leftward movement of the spool 30, the slot 32 extends from the outlet across contiguous portions of the meshing area and the demeshing area. Although the amount of pressurized fluid transferred from the outlet to the inlet is increased, thereby decreasing the discharge volume, some of the flow is passed directly through the outer most teeth spaces without accomplishing much work in these spaces. Although in terms of energy, recovery from these spaces may be low, by minimizing the differential pressure, the required torque is still somewhat reduced.

The spool 30 is preferably rectangular and moves in a rectilinear direction across the side of the intermeshing area of the gears. This particular configuration was selected so as to maximize the transfer of fluid under pressure from the outlet chamber 28 to selected portions of the meshing and demeshing gear teeth so as to provide fluid under pressure into the selected areas of the teeth to recover energy and reduce required torque. It should also be noted that a pair of spools may be provided on each face of the gears.

Another benefit of minimizing the differential pressure in the mesh area during flow reduction, is that it minimizes the heat generation in this area. Larger pumps which have larger teeth width, experience sideloading which requires more torque and loading on the bearings. The sideloading comes from the large differential pressure between the inlet and the outlet side. The present invention, by providing a high pressure fluid in the demeshing side, provides a force counter to the side loading force. This reduces side loading and, in the bypass mode, causes the large capacity pumps to have a reduced loading which is similar to that experienced by small capacity pumps.

Figure 16:
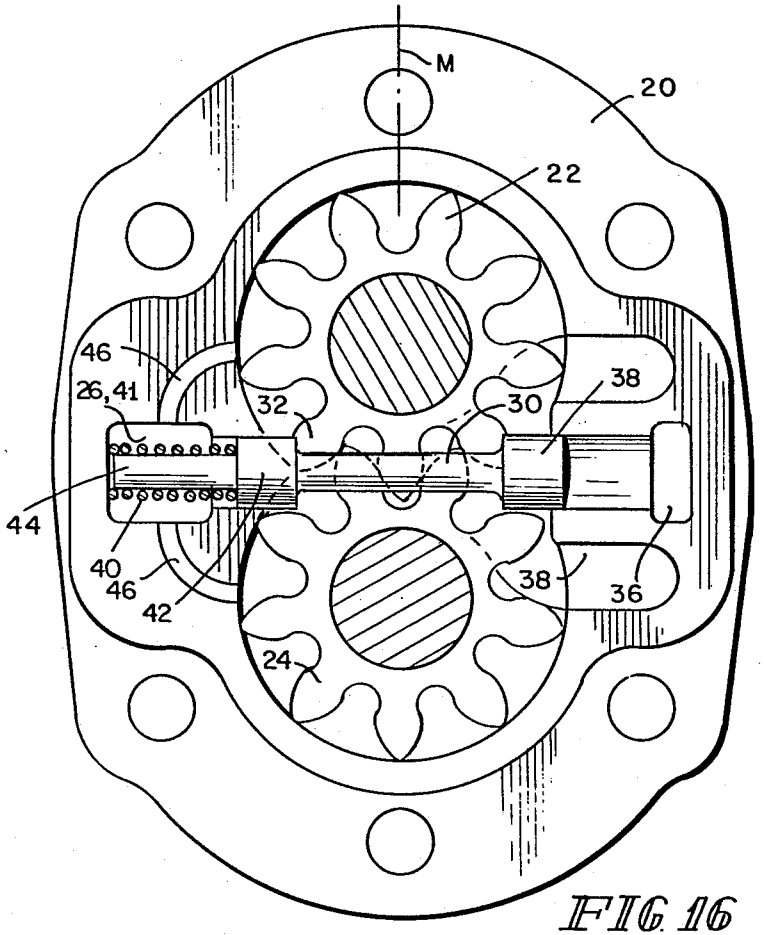
FIG. 16 is a cross-sectional view of the pump of FIG. 15 in a full bypass, maximum energy recovery mode.
Figure 15:
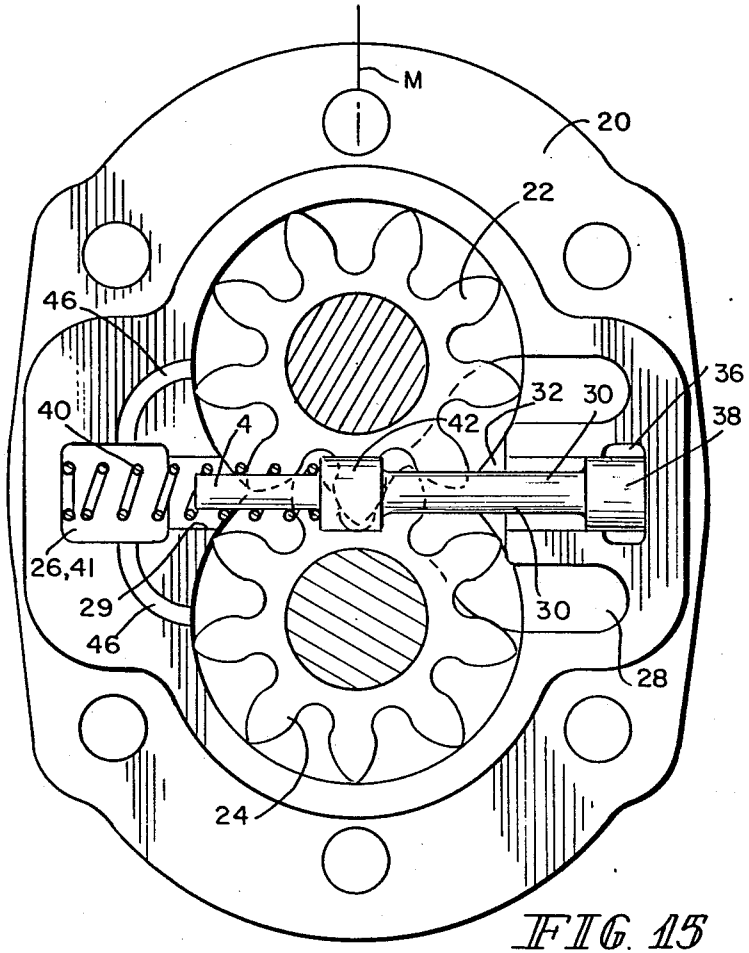
FIG. 15 is a cross-sectional view of another variable discharge gear pump having adjustable energy recovery in its full discharge zero energy recovery mode incorporating the principles of the present invention.
Figure 17:
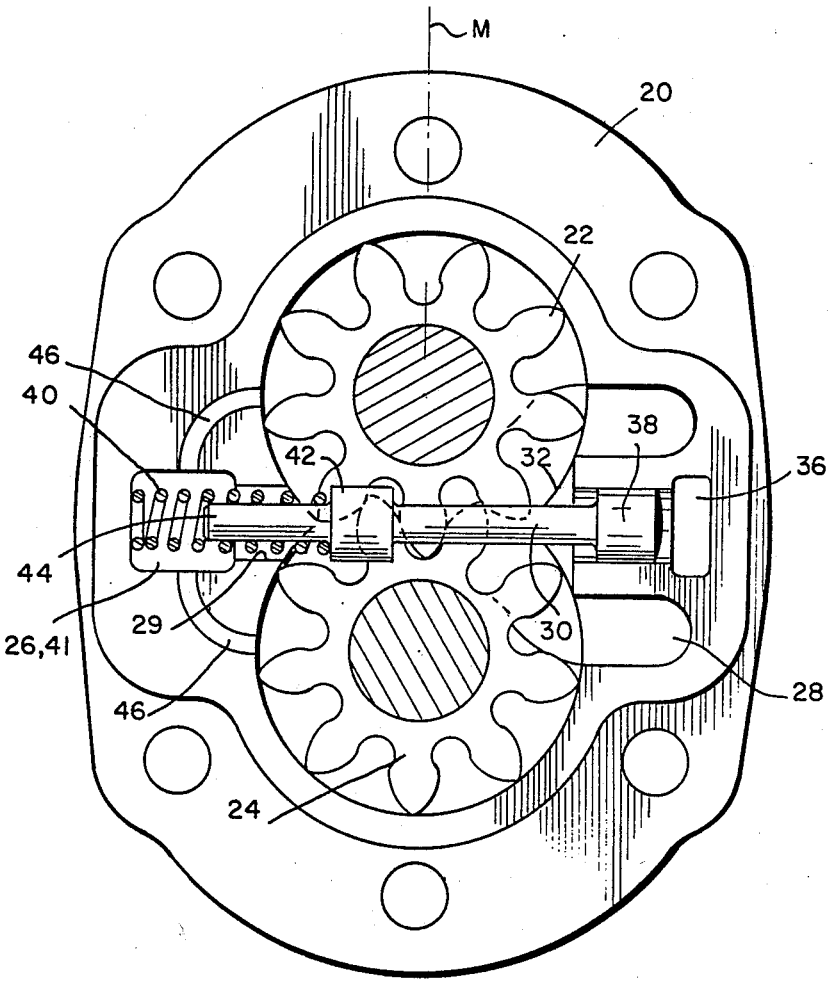
FIG. 17 is a cross-sectional view of the pump of FIG. 15 in a less than full discharge, partial energy recovery mode.

In order to increase the energy recovery, the embodiment of FIGS. 15–17 increase the pressure in the demeshing area with decreasing delivery or conversely increasing bypass by providing an inlet adjustment. By continuously decreasing the meshing area's exposure to the inlet, the bypassed outlet fluid meets greater resistance to escaping towards the inlet and therefore, a greater buildup in pressure in the demeshing area is produced. This substantially increases the amount of energy recovery or conversely, reduces the amount of torque needed to drive the gear pump.

To achieve this end, the housing 20 of the gear pump is modified such that the inlet chamber 26 is connected to the demeshing area primarily through a bore 29. The end 42 or land of the spool 30 slides within the bore 29 and controls the interconnection between the inlet chamber 26 and the demeshing area of gear teeth 22 and 24. The spool 30 in FIGS. 15–17, as compared to the spool in FIGS. 1–4, includes a stop 44 extending from the inlet end 42 of the spool 30 which, as illustrated in FIG. 16, engages the housing at the full bypass position. The stop 44 also forms a guide for the spring 40. The slot 32 of the spool 30 is not an interior slot as in FIGS. 1–4, but is produced by circumferially reducing the diameter of the spool to create a circumferial recess or slot between the lands 38 and 40 of the spool 30.

In the full discharge, zero energy recovery mode of FIG. 15, the recess 32 does not extend across the center line M and therefore the outlet 28 is only connected to the meshing teeth. The land 44 is in its fully rightward position allowing full communication between the inlet chamber 26 and the demeshing area of the teeth through bore 29.

Figure 18:
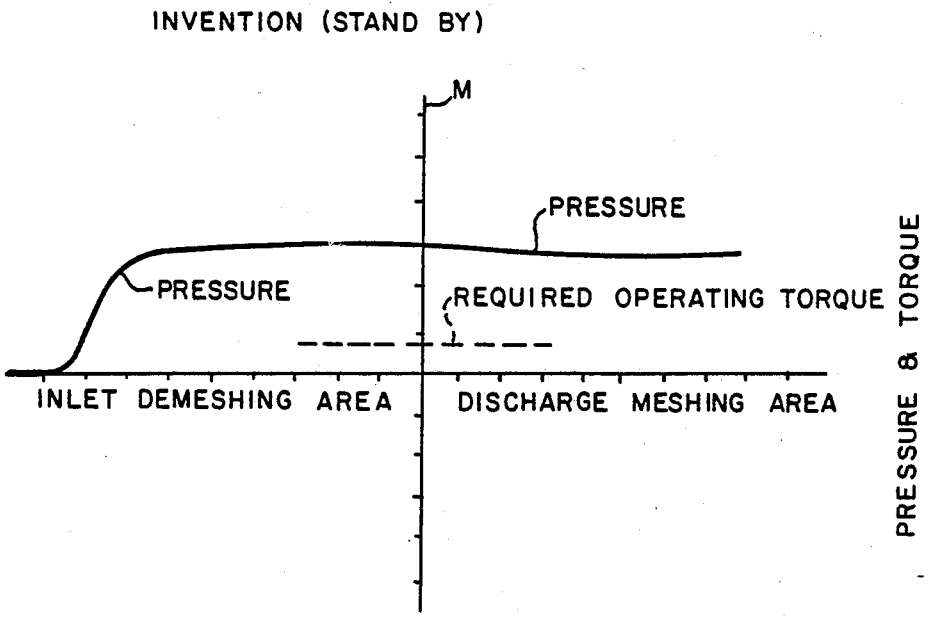
FIG. 18 is a pressure torque graph of a pump according to the invention as in FIG. 16 at standby or full bypass.

In a stand-by or full bypass high energy recovery mode, as illustrated in FIG. 16, the recess 32 connects the outlet 28 to the meshing and demeshing area equalizing pressure thereacross. The land 42 slides in bore 29 completely blocking the inlet chamber 26 from the demeshing area. This prevents the fed-back high pressure fluid from the outlet from escaping back into the inlet and thereby maximizes the pressure in the demeshing area and increases energy recovery. A comparison between the graphs of FIGS. 14 and 18 will indicate the increase in pressure in the demeshing area.

Figure 19:
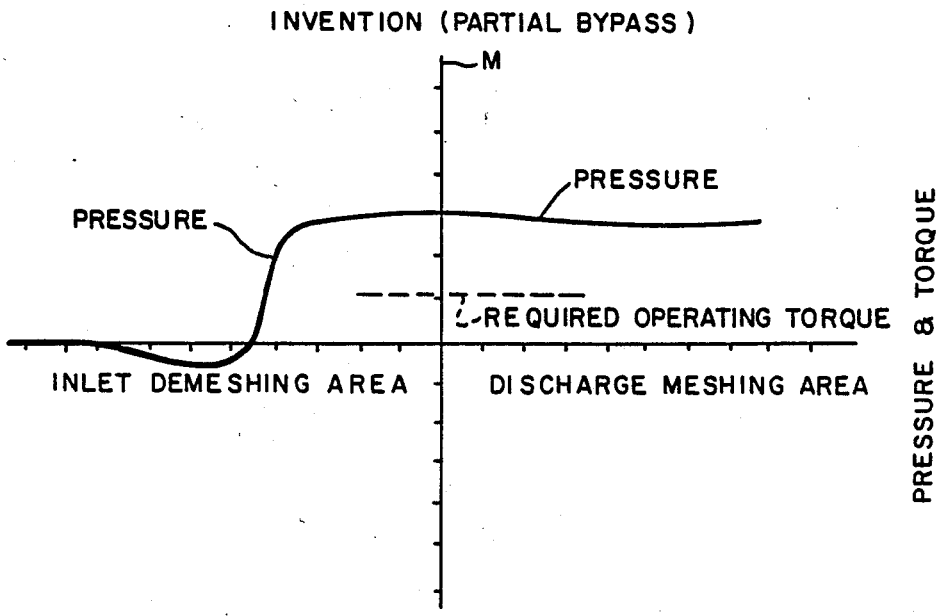
FIG. 19 is a pressure torque graph of a pump according to the invention as in FIG. 17 with partial bypass.

In the partial bypass energy recovery mode of FIG. 17, the recess 32 is positioned so that it extends across the center line M providing high pressurized fluid from the outlet 28 to the meshing and demeshing area causing a bypass. The land 42 at the inlet begins to restrict the outlet of bore 29 as compared to that of FIG. 15. This restricts the ability of the bypass fluid from flowing freely to the inlet and thereby increases the pressure in the demeshing area. The result of providing the inlet control can be seen from comparing FIG. 19 with FIG. 10.

A pair of channels 46 are shown connecting the inlet chamber 26 and the gear teeth 22 and 24 outside the demeshing area. This prevents cavitation in the gear teeth as they travel towards the outlet 28 which may result from the use of the land 42 as an inlet control valve. Also, at high speeds irrespective of the position of the inlet control portion 42 of the spool 30, they will also prevent cavitation. Although the channels 46 provide secondary flow in FIGS. 15–17, they may also be added to the embodiment of FIGS. 1–4.

Although the present invention has been described and illustrated in detail, it is to be clearly understood that the same is by way of illustration and example only, and is not to be taken by way of limitation. The principles of the present invention are also applicable to gear motors wherein the output speed and the torque of the gear motors are adjusted by the position of the spool. The spirit and scope of the present invention are to be limited only by the terms of the appended claims.

I claim:

1. A variable discharge gear pump comprising:

an inlet chamber and outlet chamber;

a pair of gears rotatable about parallel axis in opposite direction and having an intermeshing area between said inlet and outlet chambers, said intermeshing area having a meshing area of decreasing displacement at said outlet chamber and a demeshing area of increasing displacement at said inlet chamber;

outlet adjustment means in fluid communication with said outlet chamber for adjustably providing high pressurized fluid from said outlet chamber to selected portions of said demeshing area adjacent said meshing area of said intermeshed gears to vary the discharge flow of the pump and vary the amount of energy recovery;

inlet adjustment means connecting said inlet chamber and said demeshing area for variably controlling fluid flow between said inlet chamber and said demeshing area to vary the amount of energy recovery; and coordinating means for coordinating said inlet adjustment means and said outlet adjustment means whereby said fluid flow between said inlet chamber and said demeshing area decreases with decreased discharge flow thereby increasing energy recovery.

2. A variable discharge gear pump according to claim 1, wherein said inlet and outlet adjustment means and said coordinating means include a common spool having a slot and an inlet land, said slot being in continuous communication with outlet chamber, said inlet land varying primary fluid flow between said inlet chamber and said demeshing area and positioning means for moving said spool rectilinearly along an axis to align said slot in communication with selected portions of said intermeshing area and vary said inlet primary fluid flow.

3. A variable discharge gear pump according to claim 1, including secondary channel means continuously connecting said inlet to said gear teeth exterior of said intermeshing area for preventing cavitation without decreasing energy recovery.

4. A variable discharge gear pump comprising:

an inlet chamber and outlet chamber;

a pair of gears rotatable about parallel axis in opposite direction and having an intermeshing area between said inlet and outlet chambers, said intermeshing area having a meshing area of decreasing displacement at said outlet chamber and a demeshing area of increasing displacement at said inlet chamber;

outlet adjustment means in fluid communication with said outlet chamber for adjustably providing high pressurized fluid from said outlet chamber to selected portions of said demeshing area adjacent said meshing area of said intermeshed gears to vary the discharge flow of the pump and vary the amount of energy recovery;

inlet adjustment means connecting said inlet chamber and said demeshing area for variably controlling fluid flow between said inlet chamber and said demeshing area to vary the amount of energy recovery; and said adjustment means includes a spool having a slot, said slot being in continuous communication with said outlet chamber and positioning means for moving said spool rectilinearly along an axis to align said slot in communication with selected portions of said intermeshing area.

5. A variable discharge gear pump according to claim 4, wherein said adjustment means includes a channel connecting said outlet and said intermeshing area of sufficient dimension to assure sufficient fluid of a high pressure is provided to said selected portions of said demeshing area of said gears.

6. A variable discharge gear pump according to claim 4, wherein said positioning means moves said slot to extend over said outlet chamber and contiguous portions of said meshing and demeshing areas.

7. A variable discharge gear pump according to claim 4, wherein said outlet adjustment means adjustably maintains a high positive pressure in selected portions of said demeshing area adjacent said meshing area to vary the amount of energy recovery.

8. A variable discharge gear pump according to claim 4, wherein said outlet adjustment means adjustably equalizes pressure in selected portions of said meshing and adjacent demeshing areas to pressure in said outlet chamber to vary the discharge flow of the pump and vary the amount of energy recovery.

9. A variable discharge gear pump according to claim 4, wherein said gears include teeth having a height and said slot having a width substantially equal to said height so as to overlap said teeth in said intermeshing area.

10. A variable discharge gear pump according to claim 9, wherein said axis of rectilinear movement of said spool is perpendicular to a plane of said parallel axis of rotation of said gears and is equidistance from said parallel axis.

* * * * *